United States Patent [19]

Gwin et al.

[11] Patent Number: 5,021,126

[45] Date of Patent: Jun. 4, 1991

[54] DRUM WASHER HAVING LIQUID COLLECTING MEANS

[75] Inventors: Dennis L. Gwin, Clatskanie, Oreg.; Keith T. Van Scotter, Boise, Id.; Ron L. Montgomery, Trenton, N.J.

[73] Assignee: Union Camp Corporation, Wayne, N.J.

[21] Appl. No.: 466,948

[22] Filed: Jan. 18, 1990

Related U.S. Application Data

[63] Continuation-in-part of Ser. No. 394,277, Aug. 15, 1989, abandoned, which is a continuation-in-part of Ser. No. 877,370, Jun. 23, 1986, abandoned.

[51] Int. Cl.[5] ..... D21C 9/00; D21C 9/06

[52] U.S. Cl. ..... 162/263; 162/60; 68/45; 68/181 R; 210/92; 210/402; 210/416.1

[58] Field of Search ..... 162/49, 60, 263, DIG. 10, 162/258; 68/13 R, 181 R, 45, 22 R; 210/746, 92, 96.1

[56] References Cited

U.S. PATENT DOCUMENTS

| | | | |
|---|---|---|---|
| 2,204,225 | 6/1940 | Merckel | 210/92 |
| 4,046,621 | 9/1977 | Sexton | 162/49 |
| 4,096,028 | 6/1978 | Rosenberger | 162/49 |

*Primary Examiner*—Steve Alvo

*Attorney, Agent, or Firm*—Edward J. Sites

[57] ABSTRACT

In a drum washer for washing the pulp for making paper to remove pulping liquors, the method and apparatus for providing the filtrate liquid being drained from the drum and pulp mat during a portion of the rotation cut-off which liquid can be continuously sampled and analyzed to give a more positive indication of washing efficiency.

2 Claims, 3 Drawing Sheets

DRUM WASHER HAVING LIQUID COLLECTING MEANS

RELATED APPLICATIONS

This application is a Continuation-In-Part application of U.S. application Ser. No. 394,277 filed Aug. 15, 1989, now abandoned, which in turn is a Continuation-In-Part of U.S. application Ser. No. 877,370 filed June 23, 1986, now abandoned.

BACKGROUND OF THE INVENTION a. Field of the Invention

The invention relates to one of the steps in the pulping of cellulosic materials to make paper and more particularly to a drum washer for washing of the pulp to remove pulping liquors and the filtrate liquid sampling system of such drum washer to provide a continuous correlatable measurement of the solids content in the mat discharged from the drum washer.

b. Description of the Prior Art

The prior art includes measurement of drop leg conductivity. Since most of this filtrate is recycled back to the washer vat and includes all filtrate drawn through the drum, it is considered an insensitive measure of discharge mat solids concentration and therefore inadequate for feedback control purposes. In addition there are mat sampling techniques, but these are manual and therefore not applicable to feedback control.

The sampling system of the present invention provides a continuous fed flow of filtrate from the atmospheric port of the vacuum shoe of the drum washer. This drainage from the final displacement zone of the drum can be continuously analyzed for solids content which is a direct indication of the washing efficiency. This is useful for feedback control and optimization of the drum washer.

Such system has not been found in the prior art.

OBJECTIVES AND SUMMARY OF THE INVENTION

In a process for washing pulp to remove pulping liquors for the manufacture of paper in which a cylinder covered with a fine mesh screen is rotated continuously through a vat slurry, vacuum is applied within the cylinder for a portion of the rotation and a mat of pulp is deposited on the screen as filtrate is removed from the mat, vacuum is cut off for the remainder of the rotation permitting the removal of the mat from the cylinder, the vacuum pick-up and cut-off being governed by the position of a valve segment on a vacuum valve, and the filtrate is drained from the mat and cylinder to the valve chamber at the end of the cylinder and then to a drop leg, the improved process for continuously sampling the filtrate from the mat comprising the steps of providing a passageway from the valve chamber to the atmospheric port of the valve segment; collecting the filtrate liquid from the atmospheric port as it flows by gravity from the final displacement zone of the drum when the vacuum has been cut off; and analyzing the liquid for solids content for an indication of the washing efficiency.

DETAILED DESCRIPTION OF THE INVENTION

Figure 1:
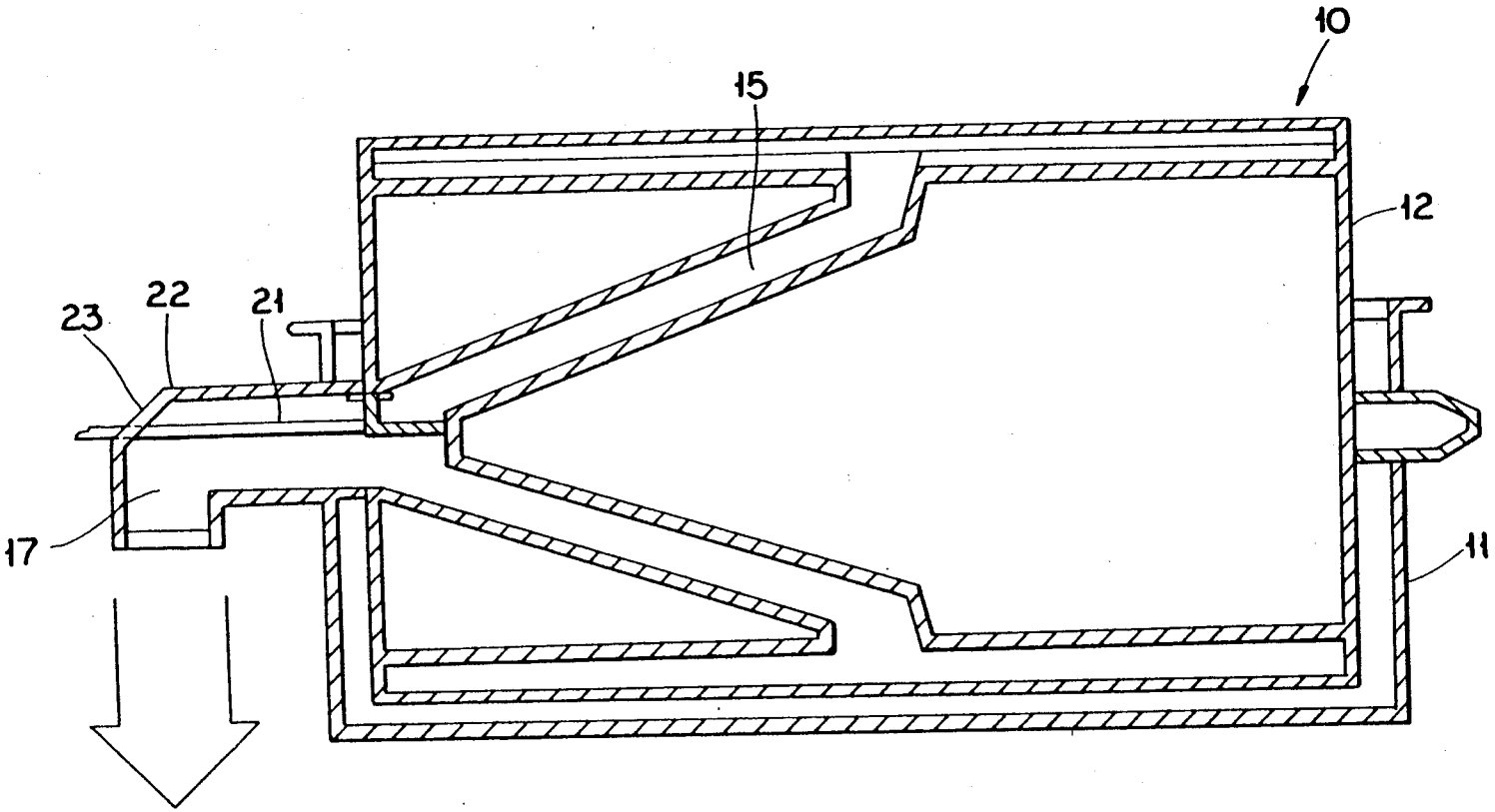
FIG. 1 is a simplified side plan view in longitudinal cross section of a drum washer, mounted on a vat, showing the valve area and drop leg.

Referring to the drawings, FIGS. 1–4 show the drum washer 10, embodying the sampling system of the present invention which comprises a main vat 11 into which is placed the rotating drum or cylinder 12. Stock 13 in the form of pulp slurry is furnished to such main vat from an inlet box 14. Drainage tubes 15 are carried within the drum. The outer face is covered with a fine mesh screen 16 supported by a spirally wound heavy wire. A filtrate drop leg 17 is utilized to remove the filtrate collected from tubes 15 as described below.

Figure 4:
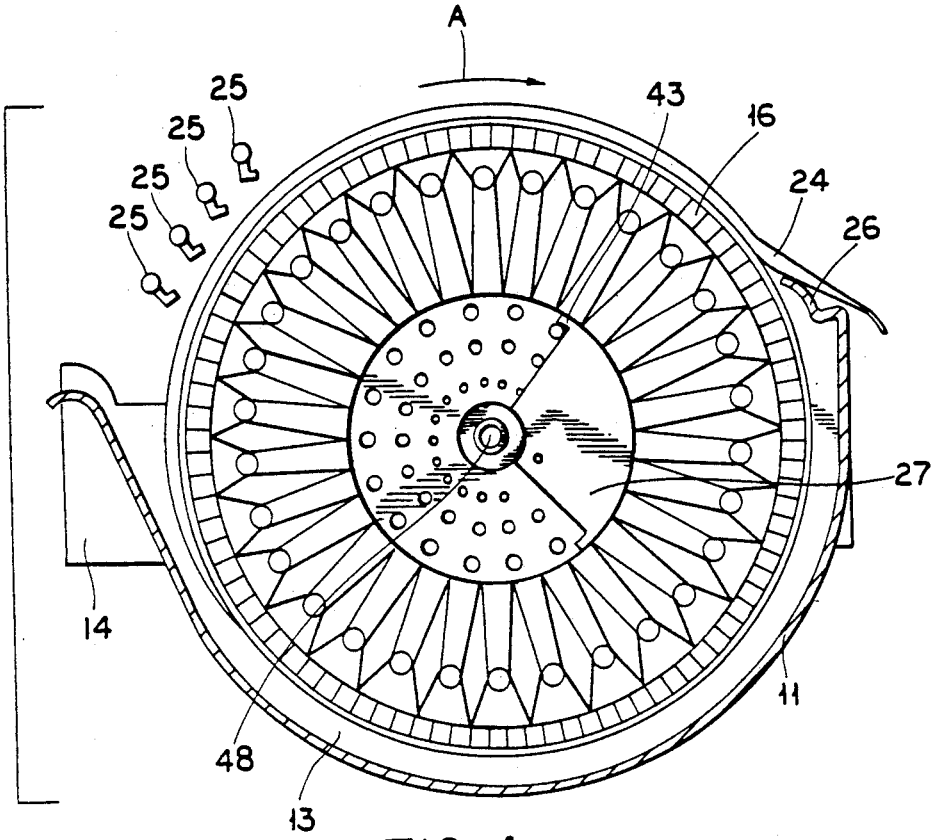
FIG. 4 is a simplified end view, in cross section, of the cylinder of the drum washer shown in FIG. 1.
Figure 3:
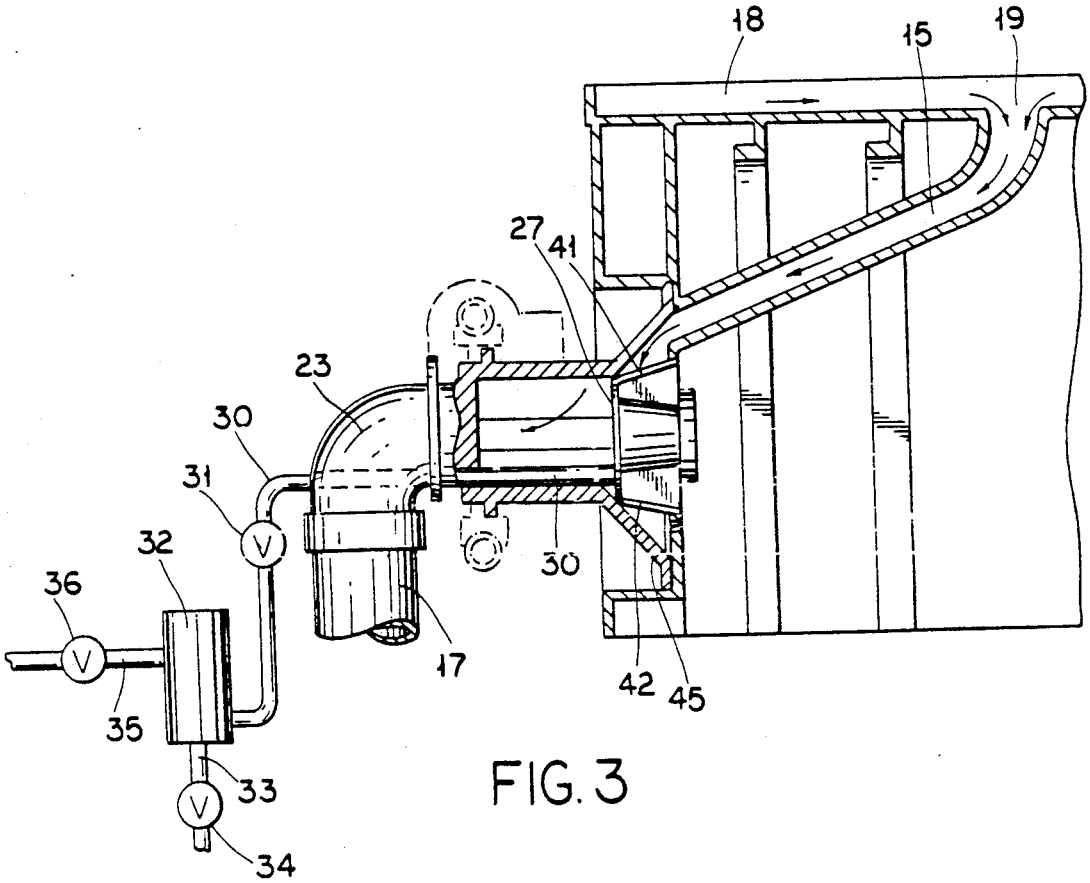
FIG. 3 is a side view, in cross section, showing a portion of the cylinder, valve and drop leg of the drum washer of FIG. 1 and the sampling system of the present invention.
Figure 2:
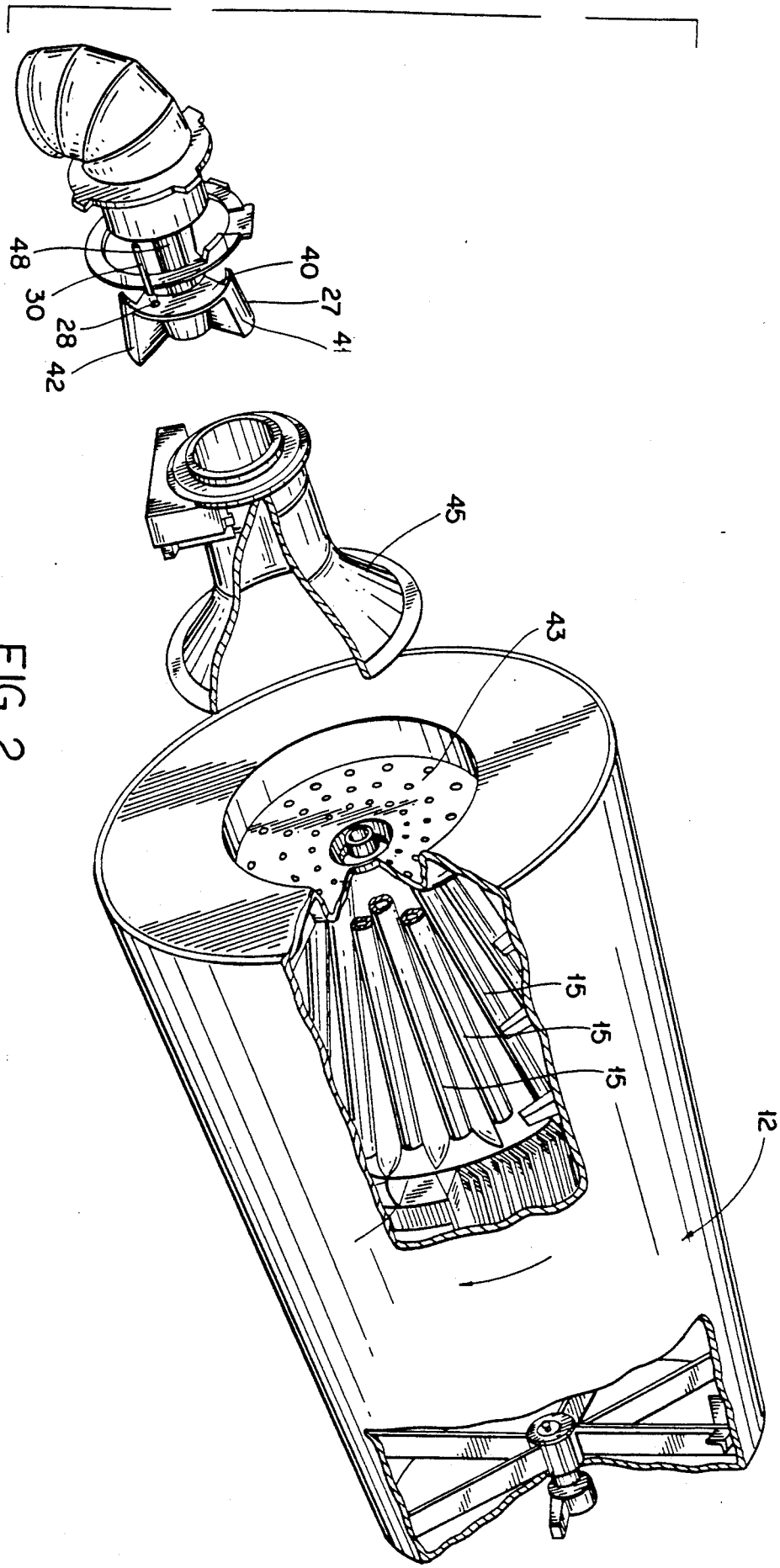
FIG. 2 is an exploded isometric view of the cylinder, valve and drop leg of the drum washer of FIG. 1.

Filtrate passes from the pulp through the fine mesh screen to the drum surface where longitudinal flow channels 18 formed by a series of support grids carry the filtrate to center-point (or quarter-point) drain ports 19 (FIG. 4). Drainage tubes 15 internal to the drum convey the filtrate from the drain ports 19 to a centrally positioned valve chamber 21 in the valve 22 at the end of the drum, through a discharge elbow 23, to the drop leg 17 leading to a filtrate seal tank, and a vacuum source (not shown).

Disposed within valve chamber 21 is a valve segment 27. The valve chamber has an end wall 40 and two arcuate walls 41 and 42. As seen more clearly in FIG. 4, drum 12 has at one end a central wall 43. Each drain pipe 15 terminates at wall 43. While wall 43 rotates with drum 12, valve segment 27 is stationary and may be positioned at any preselected angle around shaft 48. In operation, vacuum through pipe 17 is applied to chamber 21, and through the chamber to the majority of drainage tubes 15. However, arcuate walls 41, 42 are in contact with the inner wall on conical cap 45 to form a seal therewith. Therefore, the tubes 15 opening at any given time into the space defined by the valve segment 27, and the cap 45 are not subjected to vacuum, but are at atmospheric pressure.

The end wall 40 of valve segment 27 is provided with a port 28 to permit access into the space defined by the segment. The structure described so far has been known in the prior art.

In the present invention, port 28 is connected to a conduit 30 provided to take samples of the filtrate therefrom.

The apparatus described above operates as follows. As the filter drum rotates in the direction indicated by arrow A into the pulp slurry 13, fed into the vat from the inlet box 14, initial submergence of a division, or section of the drum, of the filtration surface is attended by a gentle dewatering of the slurry and deposition of a thin layer of fibers on the face wire covering that division. This action is duplicated on succeeding sections as they enter submergence.

As the drum continues in rotation, the drainage sections advance into a full vacuum action zone in accordance with the valve setting, and rapid dewatering commences with a commensurate pick-up of fiber on the face wire until emergence of the drainage section from the pulp slurry. Following emergence, full vacuum action continues permitting further dewatering of the pulp mat 24 and application of wash water showers 25, if required, thus effecting efficient washing of the pulp mat. Vacuum action and dewatering continue until the drainage section reaches the vacuum cut-off position defined by segment 27. The pulp mat is removed at atmospheric pressure by means of a choice of take-off (doctoring) devices 26.

As stated, the vacuum action is determined by the action of the valve chamber 21. The vacuum is applied through the drop leg 17 and valve chamber 21 into the drum 12, thus creating a siphon effect in the drum. The valve, which is stationary and does not rotate with the drum, is provided with the valve segment 27, containing an atmospheric port 28. The segment 27 controls the vacuum cut-off and pick-up points circumferentially around the drum (FIG. 4). When the vacuum is "on", all the filtrate is drawn through the drum into the valve chamber 21 and the drop leg 17. In some cases, where several drum washers are connected together and the filtrate is cycled through all of them, the filtrate passing through the valve chamber would include filtrate from all the drum washers.

Filtrate from the tubes 15 corresponding to the sections of the drum 12 still in contact with the pulp mat collects inside segment 27, and drains through the tubes 15 having a downward slope.

To sample the filtrate in the system requires either taking a sample of the filtrate from the drop leg 17, which, as pointed out above, is unsatisfactory for sampling and feedback, or sampling manually the mat being produced, which is likewise unsatisfactory and not applicable to feedback control.

The sampling system of the present invention comprises conduit 30 connected to the atmospheric port 28 of the valve segment 27. The conduit 30 passes through the valve chamber 21 and is used for sampling the filtrate collected in the segment 27. The conduit 30 leads through a shut-off valve 31 into a sample pot 32 where conductivity can be continuously measured. The pot is provided with a drain pipe 33 and a valve 34 and also with a pipe 35 at the top of the pot with a valve 36 for discarding sample filtrate.

The flow of filtrate is virtually continuous from the atmospheric port of the valve segment of the drum washer. This filtrate from the final displacement zone of the drum can be continuously analyzed for solids content which is a direct indication of the washing efficiency. This is a useful criteria for feedback control and optimization of the drum washer.

Those skilled in the art will appreciate that many variations of the above described embodiment of the invention may be made without departing from the spirit and scope of the invention.

I claim:

1. A drum washer for washing pulp for paper manufacture for continuously sampling filtrate from said pulp, comprising:

a vat;

means to feed a pulp slurry into the vat;

a mesh covered cylinder mounted for continuous rotation in the vat and through the slurry;

means to apply vacuum within the cylinder for a portion of the rotation of the cylinder to deposit a mat on the cylinder;

means to cut off the vacuum within the cylinder for the remainder of the rotation of the cylinder to permit removal of the mat from the cylinder;

a valve connected at the end of the cylinder provided with a valve chamber and a valve segment having an atmospheric port, said segment governing the application and cut-off of the vacuum during rotation of the cylinder;

a drop leg connected to the valve chamber; and drainage means within the cylinder to drain liquid from the mat and cylinder to the end of the cylinder and then to the valve chamber and drop leg; and conduit means having a first and second end and having its first end connected to the atmospheric port of the valve segment and passing through the valve chamber, the second end of the conduit connected to a means for collecting the liquid at the atmospheric port as it flows by gravity from the final displacement zone of the cylinder when the vacuum has been cut off, whereby the liquid can be analyzed for solids content for an indication of the washing efficiency.

2. The apparatus of claim 1 in which the means for collecting the liquid is a sample pot connected by piping from the atmospheric port to the sample pot where the liquid can be continuously sampled and analyzed.

* * * * *